US005553400A

United States Patent [19]

Wittmann et al.

[11] Patent Number: 5,553,400

[45] Date of Patent: Sep. 10, 1996

[54] PRESSURE-DISTRIBUTING PLATES FOR A SKI BOOT

[75] Inventors: Heinz Wittmann, Vienna, Austria; Francesco Caeran, Montebelluna, Italy; Martin Elsner, Graz, Austria

[73] Assignee: HTM Sport- und Freizeitgeraete Aktiengesellschaft, Schwechat, Austria

[21] Appl. No.: 312,390

[22] Filed: Sep. 26, 1994

[30] Foreign Application Priority Data

Sep. 27, 1993 [AT] Austria ..... 1945/93

[51] Int. Cl.[6] ..... A43B 5/04

[52] U.S. Cl. ..... 36/50.5; 36/117.1; 36/117.6

[58] Field of Search ..... 36/117, 121, 50.5, 36/115

[56] References Cited

U.S. PATENT DOCUMENTS

| | | | |
|---|---|---|---|
| 3,530,596 | 9/1970 | Kaufmann et al. | 36/99 |
| 4,937,953 | 7/1990 | Walkhoff | 36/119 |
| 5,065,481 | 11/1991 | Walkhoff | 36/50.5 X |
| 5,189,815 | 3/1993 | Pozzobon et al. | 36/117 |
| 5,381,611 | 1/1995 | Tonel et al. | 36/50.5 X |

FOREIGN PATENT DOCUMENTS

| | | | |
|---|---|---|---|
| 0020315 | 12/1980 | European Pat. Off. | 36/117 |
| 0053340 | 6/1982 | European Pat. Off. . | |
| 0353532 | 2/1990 | European Pat. Off. . | |
| 0570048 | 11/1993 | European Pat. Off. . | |
| 1083590 | 1/1955 | France | 36/117 |
| 2341658 | 3/1974 | Germany . | |
| 2409380 | 9/1975 | Germany . | |
| 3937511 | 6/1990 | Germany . | |
| 0265506 | 3/1950 | Switzerland | 36/117 |

*Primary Examiner*—Ted Kavanaugh

*Attorney, Agent, or Firm*—Flynn, Theil, Boutell & Tanis, P.C.

[57] ABSTRACT

A sports shoe, in particular a ski boot, which has a sole and an upper part formed of plastic and which has two pressure-distributing plates arranged on the outside of the upper part in the front instep area, which plates extend from the toe area of the shoe over the instep area and, bent upwardly, along the front side of the shaft of the shoe, and which are supported in the fore-foot part of the upper part for movement in a longitudinal direction of the shoe relative to the upper part and in transverse direction of the shoe, and overlap one another in the closed state of the shoe. At least one of the pressure-distributing plates is mounted in the instep area with one or several hinges on the upper part of the shoe, which hinges enable a swinging movement of this pressure-distributing plate away from the other pressure-distributing plate for opening wide the instep area.

12 Claims, 3 Drawing Sheets

PRESSURE-DISTRIBUTING PLATES FOR A SKI BOOT

FIELD OF THE INVENTION

The invention relates to a sports shoe, in particular a ski boot, which has a sole and an upper part formed of a plastic, and which has in the front instep area two pressure-distributing plates arranged on the outside of the upper part, which plates extend from the toe area of the shoe over the front instep area and, bent upwardly, along the front side of the shaft of the shoe, and which are supported in the fore-foot area of the upper part for movement in a longitudinal direction of the shoe relative to said upper part and in transverse direction of the shoe, and overlap one another in the closed state of the shoe.

BACKGROUND OF THE INVENTION

The pressure-distributing plates provided in ski boots or shoes of the above mentioned type are supposed to absorb and distribute the forces, which result during a tight clamping of the shoes, as this is done in order to achieve a solid fit of the shoe, in order to essentially avoid a point-focal effect of pressure-applying forces onto the foot; these pressure-distributing plates are furthermore supposed to achieve through their movability an adaptation of the shape of the shoe to the shape of the foot. These pressure-distributing plates, which are connected directly or indirectly on the right and on the left side of the front instep opening of the shoes to the upper part of the shoe, must for stepping into the shoes and for exiting from the shoes be moved away from one another in transverse direction of the shoe in order to render wide the instep opening and to thus enable a stepping into and a stepping out of the shoe.

Sports shoes of the above mentioned type are known in which the pressure-distributing plates are mounted directly to the upper part of the shoe by rivets which extend through slotted holes provided in the pressure-distributing plates at the connecting points; thus a longitudinal movability of the pressure-distributing plates relative to the upper part of the shoe exists. In order to move the pressure-distributing plates apart in transverse direction of the shoe for opening of the front instep openings of the shoes, those zones of the upper parts of the shoe, where the pressure-distributing plates are mounted, and, if necessary, also the pressure-distributing plates themselves must be bent away from one another under an elastic deformation; such a bending apart often requires an awkward handling. On the one hand, the moving apart of the pressure-distributing plates demands a certain application of force and, on the other hand, the pressure-distributing plates must be held apart during stepping in and stepping out in order to counteract the elastic forces which try to move the bent-apart pressure-distributing plates again toward one another; an undesired stress on the material results also from the bending apart of the pressure-distributing plates, which bending apart is carried out for the stepping in and stepping out, which stress on the material can reduce the lifetime of the shoes.

Furthermore, a sports shoe is known from EP-B1-0 316 540 which has two holding elements arranged inside of the shaft of the shoe, which holding elements are designed saddlelike and extend side-by-side in longitudinal direction of the shoe from the fore-foot area over the front instep area. These holding elements are connected at their front ends to the shaft of the shoe, with this connection being formed by slotted holes and guide bolts received in said slotted holes and permitting a movement of these front ends relative to the shaft of the shoe in longitudinal direction of the shoe and transversely thereto. These holding elements are pulled with Bowden cables or flexible wires against the front instep area of the foot or an inner shoe surrounding the foot.

Throughout this application, sports shoe includes and specifically refers to a ski boot.

SUMMARY OF THE INVENTION

It is a goal of the invention to provide a sports shoe of the above mentioned type in which problems of the aforementioned type are overcome, and which with respect to the opening wide of the front instep opening through a moving apart of the pressure-distributing plates in transverse direction of the shoe can be easily handled, and which has a simple design, which also facilitates an easy manufacture.

The sports shoe of the invention of the above mentioned type has at least one of the pressure-distributing plates mounted in the front instep area with one or several hinges on the upper part of the shoe, which hinges enable a swinging movement of this pressure-distributing plate away from the other pressure-distributing plate for opening wide of the front instep area. This type of design meets the aforestated goal very well. Due to the fact that at least one of the two pressure-distributing plates of each shoe is mounted with one or several hinges to the upper part of the shoe, it is possible to open wide the instep opening through a simple swinging movement of one or both pressure-distributing plates, with the respective plate or the respective plates remaining thereby nonstressed in the open position and the opening itself being able to be carried out without causing the parts of the shoe to be unduly bent for this purpose. This is advantageous for achieving a long life of the shoe.

One embodiment of the sports shoe designed according to the invention, which permits a very easy moving of the pressure-distributing plates to the side and thereby assures with a simple design also a long life expectancy of the hinge bearing, is characterized such that the hinges are formed by swivel arms which are provided on tensioning-lever buckles provided for closing of the shoe, on which swivel arms is fastened at least one of the pressure-distributing plates of the respective shoe. A preferred further development of the last mentioned embodiment, which further development shows aside of a simple design also a kinematically advantageous behavior during closing of the shoe with the tensioning-lever buckles, is thereby characterized such that a swivel arm is arranged on the tensioning-lever parts of the tensioning-lever buckles mounted on one side of the upper part of the shoe, and one pressure-distributing plate of the respective shoe is mounted on that swivel arms, and that the hook parts of the clamping-lever buckles mounted on the other side of the upper part of the shoe are designed as other swivel arms, and the other pressure-distributing plate of the respective shoe is mounted on the other swivel arm. It is hereby advantageous both with respect to a structurally as simple as possible design of the tensioning-lever part of the tensioning-lever buckles and also for the free movability of tensioning lever and swivel arm, which is connected to a pressure-distributing plate, when it is provided that each tensioning lever and swivel arm provided for supporting the respective pressure-distributing plate are supported on the same swivel axis on a bearing part for the tensioning-lever part of the tensioning-lever buckles, which bearing part is fastened to the upper part of the shoe. It is furthermore advantageous for achieving a solid fit of the pressure-distributing plates on the upper part of the shoe, for achieving a good seal between the pressure-distributing plates and the upper part of the shoe, and also for achieving a long lifetime of the hinge joints, when it is provided that supporting and/or sealing ribs are formed on the pressure-distributing plates, adjacent to the hinges and on the side facing the upper part of the shoe.

Another embodiment, which has the advantage that the pressure-distributing plates can be swung far to the outside on the side facing the lower leg of the wearer of the shoe and also enables a very good adjustment of the position of the pressure-distributing plates in the shoe to the shape of the foot, is characterized such that the hinge, with which at least one of the pressure-distributing plates is mounted on the upper part of the shoe, is formed by a swivel arm associated with the respective pressure-distributing plate and consisting preferably of spring-steel crossbands, which swivel arm extends essentially in longitudinal direction of the shoe and is hingedly connected at its front end around a bolt to the upper part of the shoe, and that the respective pressure-distributing plate is supported on the swivel arm associated with the plate for movement in longitudinal direction of the swivel arm. It is thereby possible to mount or support in this manner only one of the two pressure-distributing plates of the respective shoe. However, an embodiment characterized by both pressure-distributing plates of the shoe each being mounted movably on a swivel arm of the mentioned type, is more advantageous with respect to a wide opening of the front instep. It is thereby furthermore advantageous with respect to a simple design of the above embodiment, in which the hinge is formed by a swivel arm essentially extending in longitudinal direction of the shoe, and also with respect to an advantageous set of kinematics during closing of the shoe with a tensioning-lever buckle, if it is provided that the swivel arm or the swivel arms has or have a hook, nose or the like at a point remote from the point of the hinging connection with the upper part of the shoe, into which hook, nose or the like can be engaged a pull element of a tensioning-lever buckle mounted corresponding to this hook or to this nose or the like on the upper part of the shoe. It is furthermore advantageous for the handling and also for a simple design of this embodiment, when it is provided that two pull arms are hinged to the tensioning lever of the tensioning-lever buckle, of which one pull arm, in cooperation with a hook part mounted on the oppositely lying side of the shoe, is provided for pulling together the upper part of the shoe and the pressure-distributing plates, and the other pull arm, in cooperation with the hook or the nose or the like, is provided for pulling down the respective swivel arm on the upper part of the shoe.

A further embodiment of the sports shoe designed according to the invention, which can be manufactured particularly easily since important elements, which together form the hinge connection of the upper part of the shoe with the pressure-distributing plates, can during the manufacture of the upper part of the shoe and of the pressure-distributing plates be attached at the same time, is characterized such that the hinge of each pressure-distributing plate is formed by a pair of bars provided in the front instep area and engaging hooklike, which pair of bars consists of bars extending approximately in longitudinal direction of the shoe, of which one bar is formed on the upper part of the shoe and the other bar is formed on the respective pressure-distributing plate, and these two bars are longitudinally movable relative to one another. This embodiment has also the further advantages that guide parts, which must first be mounted on the shoe, are not needed for the longitudinal movability of the pressure-distributing plates, and that also a good seal between the pressure-distributing plates and the upper part of the shoe can be achieved in the area of the hinge support of the pressure-distributing plates without requiring additional measures for this. A structurally simple solution is obtained with respect to the functional holding together of the pairs of bars, which form a hinge connection with one another, when it is provided that the two bars of a pair of bars are held to one another in transverse direction by stops. A structurally favorable solution is obtained for the stops when it is provided that the stops are formed by parts of tensioning-lever buckles, which are mounted on the upper part of the shoe adjacent to the respective pair of bars.

BRIEF DESCRIPTION OF THE DRAWINGS

The invention will now be discussed in greater detail using examples and referring to the drawings, in which.

DETAILED DESCRIPTION

Figure 1:
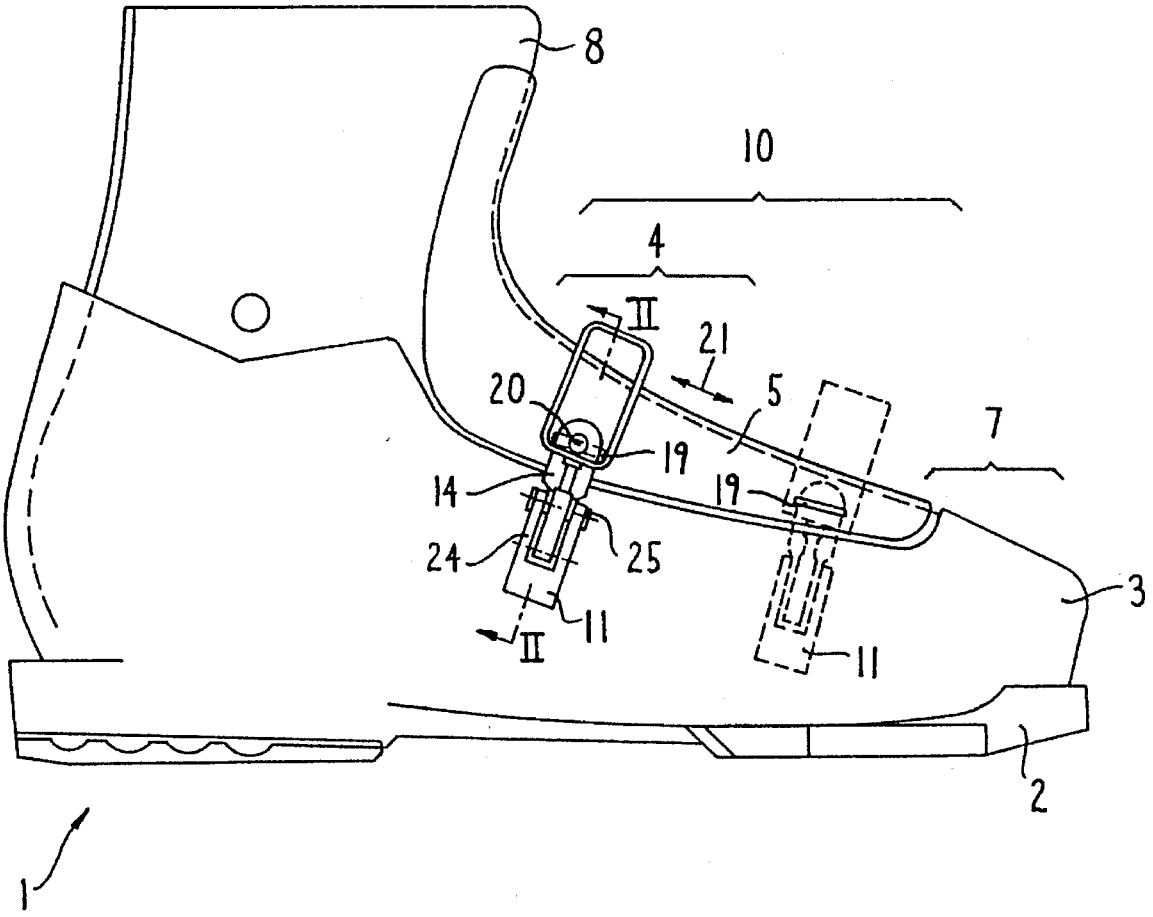
FIG. 1 is a side view of a sports shoe designed according to the invention.

The embodiment of a sports shoe 1 illustrated in FIG. 1, namely, a ski boot, has a sole 2 and an upper part 3, which are formed of plastic. This shoe has two pressure-distributing plates 5, 6 in the instep area 4, which plates extend from the area of the toe 7 over the instep area and, bent upwardly, along the front side of the shaft 8 of the shoe. The upper part 3 of the shoe 1 has, in order to form a front instep at its upper side, a longitudinally extending opening 9. Two tensioning-lever buckles 11 are provided in the fore-foot area 10 of the shoe for closing the shoe, with the upper part 3 being pulled together by a narrowing of the opening 9. The tensioning-lever buckles 11 are formed of a tensioning-lever part 12 and a hook part 13. Only one of these tensioning-lever buckles 11 is illustrated in detail in FIG. 1, the other one is only indicated by dashes. The tensioning-lever parts 12 of these tensioning-lever buckles are fastened on the one side of the upper part 3, the hook parts 13 of these tensioning-lever buckles on the other side of the upper part 3.

The pressure-distributing plates 5, 6, which have the purpose of distributing the pressures applied by the tensioning-lever buckles during closing and in the closed state onto the foot over a larger surface area, and which have the further purpose of making a stepping into and stepping out of the shoe through the opening 9 at a relatively stiffly designed upper part 3 easier, are fastened to swivel arms 14, 15, which form hinges. The swivel arms 14, in addition, pivotally support the tensioning-lever parts 12 of the tensioning-lever buckles 11, whereas the swivel arms 15 have the hook parts 13 of the tensioning-lever buckles 11 fastened thereto or, and instead, are integrally formed with the hook parts. Through this type of mounting of the pressure-distributing plates 5, 6 on swivel arms 14, 15 forming hinges, it is easily and simply possible to swing the pressure-distributing plates 5, 6 away from the opening 9 in the upper part 3, as this is indicated by the arrows 16, 17 in order to free the opening 9 in the upper part 3 of the shoe to facilitate a stepping into and stepping out of the shoe; only a small bending apart of the upper part 3 at the edges of the opening 9 is then needed in order to make this opening wide enough to allow the foot to slip through. The pressure-distributing plates 5, 6 overlap in the closed state of the shoe and cover thereby the opening 9. A further improvement of the pressure distribution and for the completion of the seal of the opening 9, a tongue 18 is provided under the opening 9 in the upper part 3.

The pressure-distributing plates 5, 6 are mounted movably in longitudinal direction of the shoe on the swivel arms 14, 15. Slotted holes 19 are for this purpose provided in the pressure-distributing plates 5, 6, into which slotted holes are received rivets 20 connecting the pressure-distributing plates 5, 6 to the swivel arms 14, 15. The pressure-distributing plates 5, 6 can through the longitudinal extent of the slotted holes 19 be moved in the longitudinal direction of the shoe with reference to the rivets 20 or with reference to the swivel arms 14, 15 on the tensioning-lever buckles 11, as this is indicated by the double arrow 21. A good adjustment of the shoes to the region of the lower legs can be achieved by this longitudinal movability of the pressure-distributing plates 5, 6. This movability of the pressure-distributing plates 5, 6 in the longitudinal direction of the shoe is enhanced by ribs 22 formed on the side of the pressure-distributing plates facing the upper part 3 and which rest on the outer side of the upper part 3 to form a seal between the upper part 3 and the pressure-distributing plates 5, 6.

The swivel arms 14 of the tensioning-lever buckles 11 are pivotally supported on a bearing part 23 secured to the upper part 3 about an axle which also pivotally supports a tensioning lever 24. The tensioning lever 12 is pivotally secured to the lever 24. Thus a very simple design of the tensioning-lever buckles is provided, which design is favorable with respect to kinematics and the distribution of forces by the pressure-distributing plates.

Figure 2:
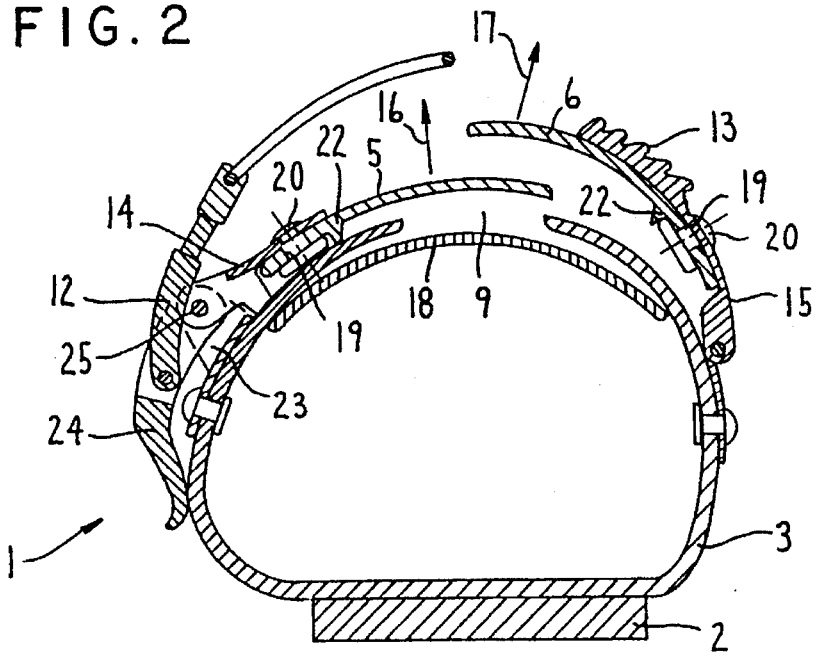
FIG. 2 is a cross-sectional view of this shoe taken along the line II—II in FIG. 1.

Both pressure-distributing plates 5, 6 are mounted on swivel arms in an embodiment of an inventively designed sports shoe illustrated in FIGS. 1 and 2 and discussed above, which plates are arranged on the tensioning-lever buckles provided for closing the shoe. It is thereby also possible, by modifying this concept, to mount only one pressure-distributing plate with hinges on the upper part of the shoe by suitably choosing the flexibility of the upper part and of the pressure-distributing plates and suitably shaping same and thereby, in particular, also the opening 9, and to fasten the other pressure-distributing plate only longitudinally movably on the upper part of the shoe, with this fastening being able to be designed selectively directly or indirectly through suitable intermediate pieces.

Figure 3:
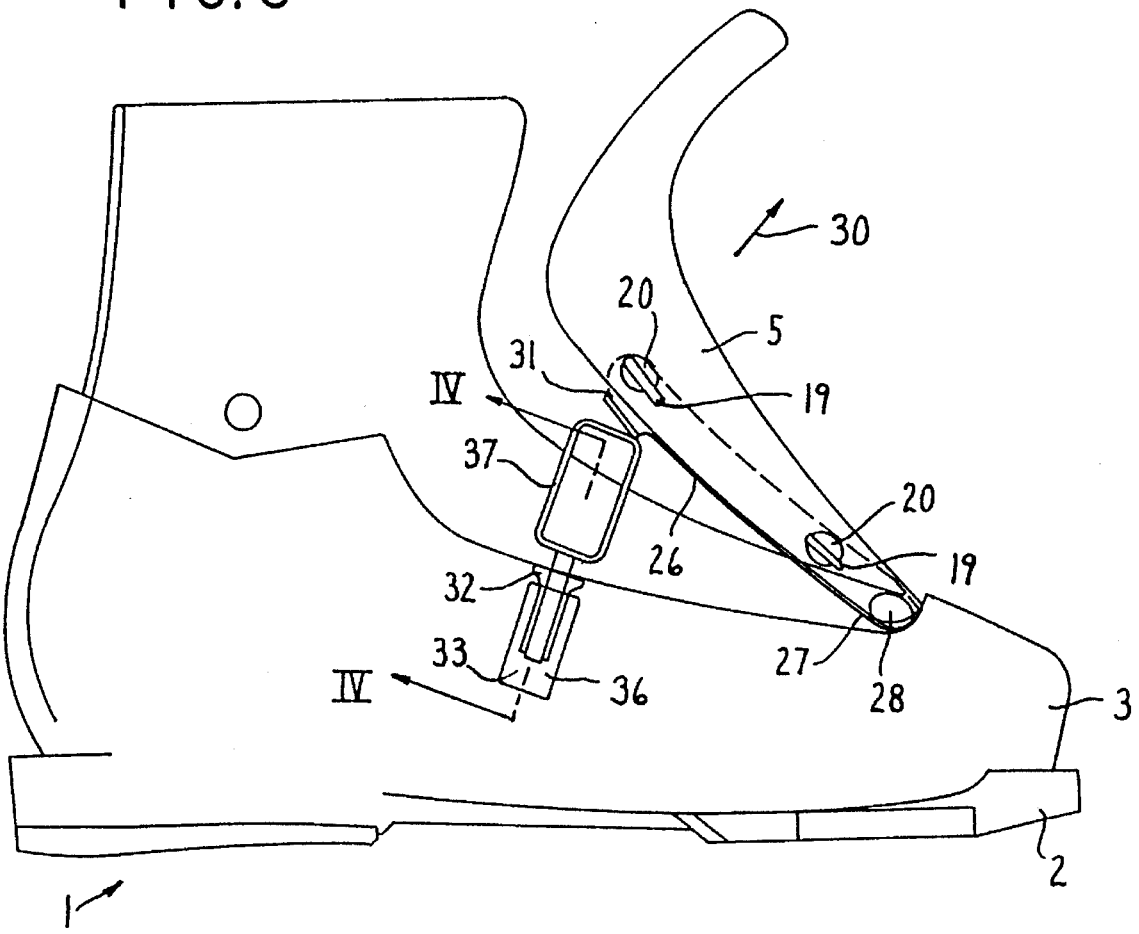
FIG. 3 is a side view of another embodiment of the sports shoe of the invention.
Figure 4:
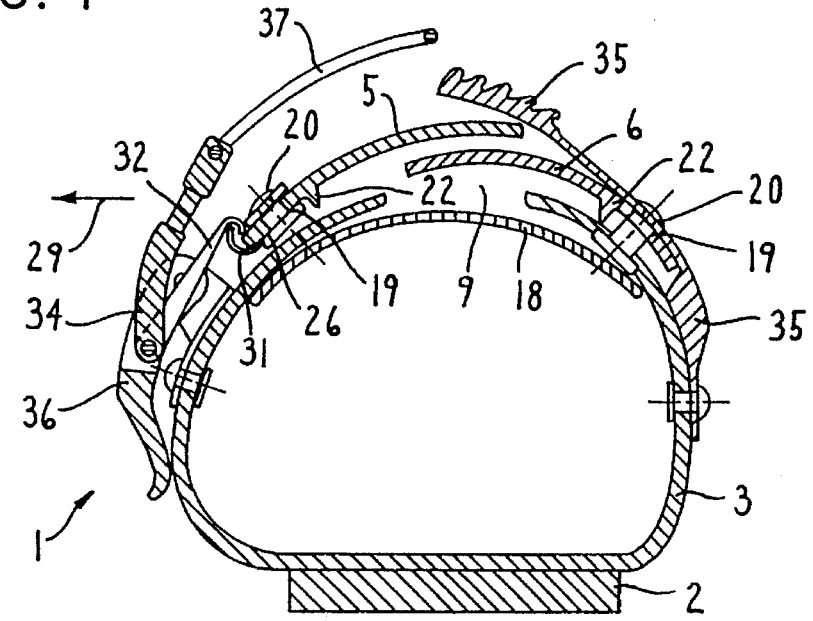
FIG. 4 is a cross-sectional view of the shoe illustrated in FIG. 3 taken along the line IV—IV in FIG. 3.

In the embodiment of an inventively designed ski shoe illustrated in FIGS. 3 and 4, the upper part 3 is designed with a longitudinally extending opening 9 which is covered on the inside by a tongue 18 and, in addition, the tensioning-lever buckles 11 provided for closing the shoe are designed similarly to the shoe according to FIGS. 1 and 2. However, the one pressure-distributing plate 5 is in the embodiment according to FIGS. 3 and 4 mounted on a swivel arm 26 so as to allow it to be movable in a longitudinal direction of the shoe, which swivel arm in turn extends essentially in a longitudinal direction of the shoe and is hingedly connected at its front end 27 to a bolt 28 secured to the upper part 3 of the shoe. Such a swivel arm 26 consists preferably of a spring-steel crossband. The connection of the pressure-distributing plate 5 to the swivel arm 26, which connection guides a movement in the longitudinal direction of the shoe, is again formed by rivets 20 received in slotted holes 19 provided in the pressure-distributing plate 5.

The other pressure-distributing plate 6 is in the embodiment illustrated in FIGS. 3 and 4 connected for longitudinal movement directly to the upper part 3, with this longitudinal movement connection being again formed by rivets 20 received in corresponding slotted holes 19 in the pressure-distributing plate 6.

The pressure-distributing plate 5 can in the embodiment according to FIGS. 3 and 4 be swung outwardly in the direction of the arrow 29 on the one hand by pivoting the swivel arm 26 about the bolt 28 connecting it to the upper part 3 and can on the other hand be lifted also in the direction of the arrow 30 by elastically bending the swivel arm 26 so that a very extensive wide presentation of the opening 9 in the upper part 3 is achieved. With respect to the other pressure-distributing plate 6, which as mentioned is mounted longitudinally movably directly on the upper part 3, one can provide by suitably choosing the material an elasticity favorable compliment to the wide presentation of the opening 9.

In order to pull the swivel arm 26 into a position corresponding to the closing position of the shoe and in order to hold same fixed in this position, the swivel arm 26 has a hook 31 into which a pull element 32 of a tensioning-lever buckle 33 mounted on the upper part of the shoe is received. The tensioning-lever buckle 33, which has a tensioning-lever part 34 and a hook part 35, serves thereby, on the one hand, to pull the upper part 3 and the pressure-distributing plates 5, 6 together in order to convert the shoe into the closed position and, on the other hand, to position the swivel arm 26 and the pressure-distributing plate 5 connected to the swivel arm into a position corresponding to the closed position of the shoe. Two pull arms are for this purpose hingedly secured to the tensioning lever 36 of the tensioning-lever buckle 33, with one of these pull arms forming the pull element 32, which can engage the hook 31, and the other pull arm 37 being provided for cooperation with the hook part 35 mounted on the oppositely lying side of the shoe or of the upper part 3 for pulling together the upper part of the shoe and the pressure-distributing plates. Thus, it is possible to carry out with one single tensioning movement of the tensioning lever 36 a positioning of the pressure-distributing plate 5 and the closing or rather pulling together of the shoe. Alternatively, it is also possible to provide for closing or pulling together of the shoe, on the one hand, and for positioning of the swivel arm 26, on the other hand, different tensioning elements, for example two tensioning-lever buckles, which are independent of one another.

The longitudinally movable connection of the pressure-distributing plate 5 relative to the swivel arm 26 is again created by rivets 20 which are fixedly situated on the swivel arm 26 and are received in the slotted holes 19 provided in the pressure-distributing plate 5. Of course, it is also possible in reverse to fix the rivets to the pressure-distributing plate and to provide slotted holes, into which these rivets are received, in the swivel arm 26; also it would be possible in principle to provide slotted holes both in the swivel arm 26 and also in the pressure-distributing plate 5, with rivets, which connect the pressure-distributing plate 5 to the swivel arm 26, each extending through a slotted hole in the pressure-distributing plate and in the swivel arm. A longitudinal movement can be achieved in this manner which corresponds approximately with the sum of the lengths of the two slotted holes.

Ribs 22 are also in the embodiment according to FIGS. 3 and 4 formed on the pressure-distributing plates 5, 6 in order to support these pressure-distributing plates on the outside of the upper part 3. The ribs 22, on the one hand, make the longitudinal movement of the pressure-distributing plates easier and, on the other hand, create a good seal between the outside of the upper part 3 and the pressure-distributing plates.

It is possible, if desired, by modifying the embodiment illustrated in FIGS. 3 and 4, to mount also two pressure-distributing plates 5, 6 each longitudinally movably on a swivel arm 26 and to thus enable the creation of a particularly wide opening of the instep or the opening 9 into the shoes.

Figure 5:
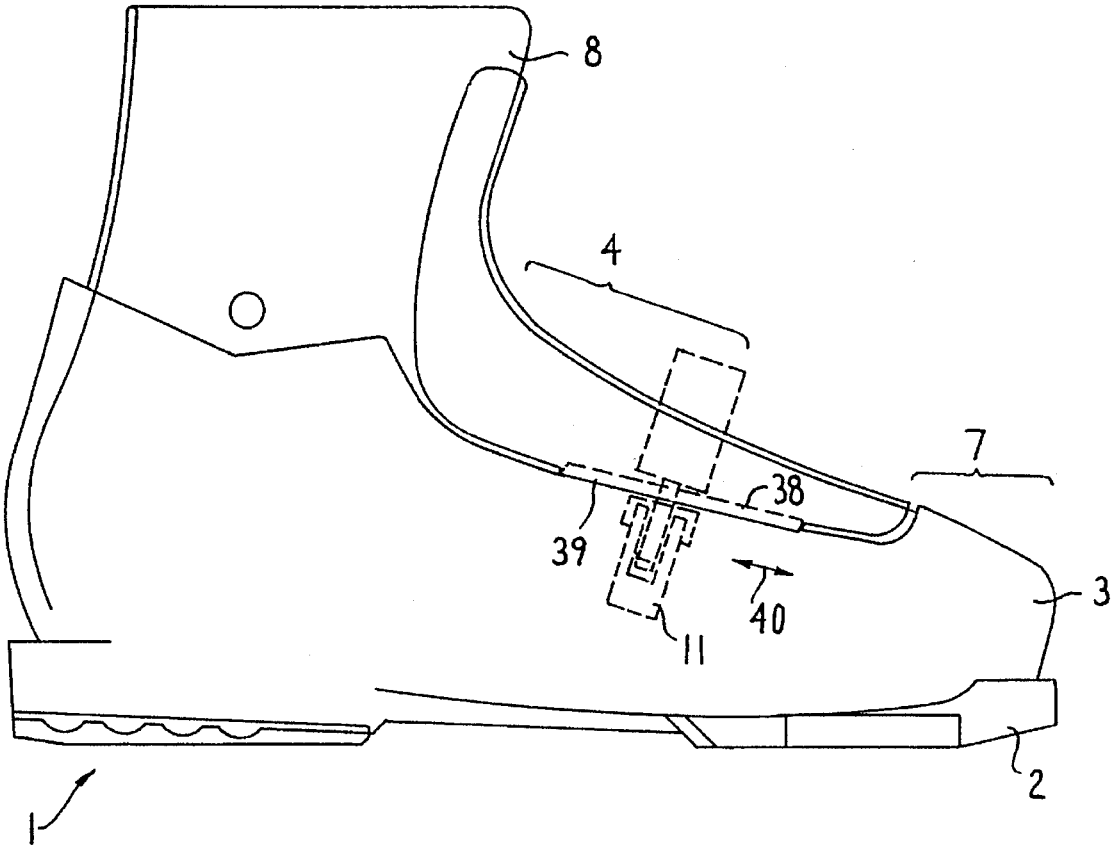
FIG. 5 is a side view of a further embodiment of a sports shoe designed according to the invention.
Figure 6:
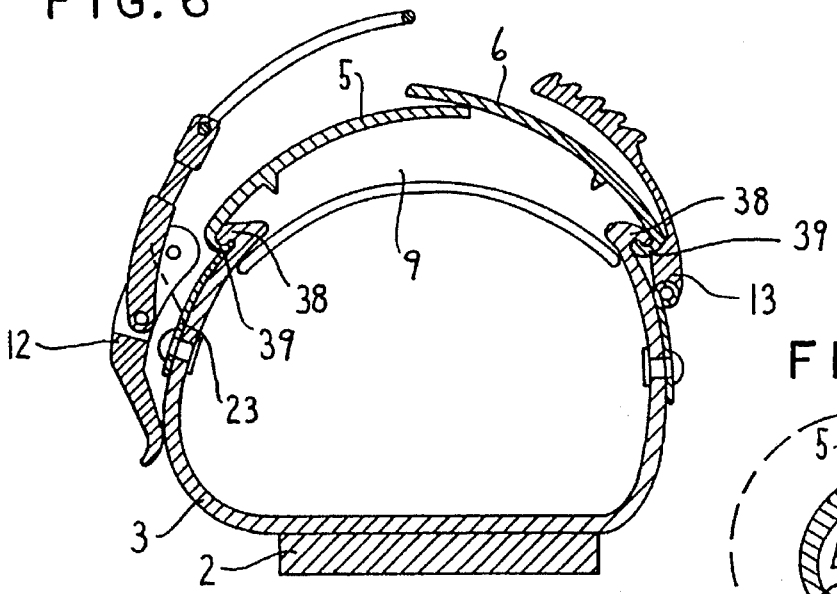
FIG. 6 is a cross-sectional view of the shoe illustrated in FIG. 5 taken along the line VI—VI in FIG. 5.
Figure 7:
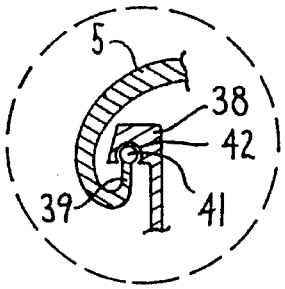
FIG. 7 shows a detail modification of the shoe construction illustrated in FIG. 6.

The upper part 3, which just like the sole 2 is formed of plastic, has in the embodiment of a sports shoe 1 illustrated in FIGS. 5 and 6 an instep opening 9, which in the closed state of the shoe is covered by pressure-distributing plates 5, 6, which overlap in the closed state of the shoe. The pressure-distributing plates 5, 6 extend from the toe area 7 of the shoe over the instep area 4, and bent upwardly along the front side of the shaft 8 of the shoe. Each pressure-distributing plate 5, 6 is thereby held on the upper part 3 by a pair of bars provided in the instep area of the shoe, which pair of bars is formed of a bar 38 formed on the upper part 3 and a bar 39 formed on the respective pressure-distributing plate 5, 6. The two bars 38, 39 forming a pair of bars with one another extend side-by-side approximately in longitudinal direction of the shoe and engage hooklike in transverse direction so that with each such pair of bars a connection of one pressure-distributing plate 5 or 6 to the upper part 3 of the shoe is formed which, on the one hand, permits a longitudinal movement of the respective pressure-distributing plate 5 or 6 relative to the upper part 3, as shown by the arrow 40 and which, on the other hand, forms a hinge with one another to facilitate a hingelike pivoting of the plates 5, 6 relative to the upper part 3 about a geometric swivel axis extending in longitudinal direction of the shoe. Stops are thereby provided for the two pairs of bars to hold the two bars 38, 39 to one another, which stops in the case shown in the drawings are formed by parts of the tensioning-lever buckles 11 provided for closing or rather clamping together of the shoe. In the case of one pair of bars, which is provided in FIG. 6 on the left side of the shoe, these stops are formed by bearing parts 23 of the tensioning-lever buckles 11, and in the case of the pair of bars illustrated on the right in FIG. 6 these stops are formed by the hook parts 13 of the tensioning-lever buckles 11. However, it is also possible to provide instead separate stop elements for holding the two bars of the pairs of bars together and which are independent of the tensioning-lever buckles 11. A further possibility to hold the two bars of the pairs of bars together in transverse direction is to provide an elastic positive lock, as it is shown in FIG. 7. If desired, such an elastic positive lock, for example, a thickened edge 41 on the one bar is received in an undercut groove 42 on the other bar, can be supplemented with stops or similar holding means.

Although particular preferred embodiments of the invention have been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In a ski boot having a sole, a frontwardly open upper part and an upwardly open front instep area with two pressure-distributing plates arranged on an outside area of said upper part and said front instep area, said plates extending from a toe area of said ski boot over said front instep area and are bent upwardly along a front side of said upper part of said ski boot and are supported in said front instep area for movement in a longitudinal direction of said ski boot relative to said upper part and for movement in a transverse direction of said ski boot, and overlap to close said open front instep area and said open upper part, the improvement comprising wherein at least one of said pressure-distributing plates is hingedly mounted in said front instep area for movement about at least one fixed hinge on said front instep area of said ski boot, said at least one fixed hinge enabling a pivoting movement of one of said pressure-distributing plates away from the other of said pressure-distributing plates for facilitating an opening of said front instep area and said upper part.

2. The ski boot according to claim 1, wherein said pressure-distributing plates each include a swivel arm pivotally mounted to said fixed hinge and operatively connectable to at least one tensioning-lever buckle for facilitating a closing of said ski boot.

3. The ski boot according to claim 2, wherein said tensioning-lever buckle includes a tensioning-lever part and a hook part, said tensioning-lever part being mounted on one side of said open front instep area of said ski boot, said one of said pressure-distributing plates of said ski boot being mounted on at least one swivel arm, wherein said hook part of said tensioning-lever buckle is mounted on the other side of said open instep area of said ski boot, and wherein an other of said swivel arms has mounted thereon the other of said pressure-distributing plates of said ski boot.

4. The ski boot according to claim 3, wherein said swivel arm consists of a spring-steel crossband extending generally in a longitudinal direction of said ski boot and is hingedly connected at its front end around a bolt to said instep area of said ski boot, and wherein a respective said pressure-distributing plate is movably mounted on said swivel arm for movement in a longitudinal direction along said swivel arm.

5. The ski boot according to claim 4, wherein both pressure distributing plates of said ski boot are each movably mounted on a respective said swivel arm.

6. The ski boot according to claim 4, wherein at least one of said swivel arms has a hook located remotely from said at least one hinge, and wherein a pull element of said tensioning-lever buckle is provided and is operatively engageable with said hook on said front instep area of said ski boot.

7. The ski boot according to claim 6, wherein a plurality of said pull elements are hingedly attached to said tensioning lever part of said tensioning-lever buckle, said hook for engaging a first pull element of said plurality of pull elements being mounted opposing said first pull element on said ski boot for pulling together of opposite sides of said open instep area of said front instep area of said ski boot and said pressure-distributing plates, and a second pull element engages a further said hook for pulling a respective said swivel arm toward said front instep area of said ski boot.

8. The ski boot according to claim 2, wherein each of said tensioning-lever parts of said tensioning-lever buckles includes a bearing part each having a swivel axis, each said bearing part being fastened to said instep area of said ski boot, and a tensioning lever supported for movement about said swivel axis of said bearing part.

9. The ski boot according to claim 2, wherein at least one supporting and sealing rib is formed on said pressure-distributing plates, adjacent to said hinges and facing said instep area of said ski boot.

10. The ski boot according to claim 1, wherein said hinge of each said pressure-distributing plate comprises a hooklike pair of bars extending generally in a longitudinal direction of said ski boot in said front instep area, one bar of said hooklike pair of bars being formed on said front instep area of said ski boot and the other bar of said hooklike pair of bars being formed on a respective said pressure-distributing plate, said pair of bars being longitudinally movable relative to one another.

11. The ski boot according to claim 10, wherein said hooklike pair of bars are held together in a transverse direction by at least one stop.

12. The ski boot according to claim 11, wherein said at least one stop is formed by parts of said tensioning-lever buckle mounted on said front instep area of said ski boot adjacent to said hooklike pair of bars.

* * * * *